US006185402B1

(12) United States Patent
Linssen

(10) Patent No.: US 6,185,402 B1
(45) Date of Patent: Feb. 6, 2001

(54) METHOD FOR AUTOMATICALLY CORRECTING IMAGE REGISTRATION AND IMAGE TRANSFER SYSTEM EMPLOYING THIS METHOD

(75) Inventor: Franciscus M. J. Linssen, Mc Echt (NL)

(73) Assignee: Oce-Technologies B.V., Ma Venlo (NL)

( * ) Notice: Under 35 U.S.C. 154(b), the term of this patent shall be extended for 0 days.

(21) Appl. No.: 09/024,133

(22) Filed: Feb. 17, 1998

(30) Foreign Application Priority Data

Feb. 17, 1997 (EP) ..... 97200428

(51) Int. Cl.[7] ..... G03G 15/01
(52) U.S. Cl. ..... 399/301
(58) Field of Search ..... 399/167, 297, 399/298, 299, 300, 301, 302, 306; 347/116

(56) References Cited

U.S. PATENT DOCUMENTS

| | | | | |
|---|---|---|---|---|
| 4,705,385 | | 11/1987 | Palm et al. . | |
| 4,796,050 | * | 1/1989 | Furuta et al. | 399/167 |
| 4,937,664 | | 6/1990 | Chiku et al. . | |
| 5,153,644 | | 10/1992 | Yang et al. . | |
| 5,373,355 | * | 12/1994 | Ando et al. | 399/301 |
| 5,452,073 | * | 9/1995 | Kataoka | 399/299 |
| 5,457,518 | | 10/1995 | Ashikaga et al. . | |
| 5,550,625 | * | 8/1996 | Takamatsu et al. | 399/301 |
| 5,768,671 | * | 6/1998 | Komiya et al. | 399/301 |
| 5,854,958 | * | 12/1998 | Tanimoto et al. | 399/301 X |

FOREIGN PATENT DOCUMENTS

| | | |
|---|---|---|
| 0191521A1 | 1/1986 | (EP) . |
| 0575162A1 | 6/1993 | (EP) . |
| 2226929A | 7/1990 | (GB) . |

* cited by examiner

*Primary Examiner*—Sandra Brase

(57) ABSTRACT

A method and system for automatically correcting image registration in an image transfer system utilizing a plurality of moving image-forming media on each of which an image is formed in response to a corresponding start-of-page signal, and an image carrier moving past each of the image-forming media and brought into contact therewith in a transfer zone, wherein the image-forming media are driven independently from one another and the timing of the start-of-page signals and/or the speed of the image-forming media are controlled to maintain a fixed relationship between the longitudinal image distortions occurring in each transfer zone and the timing of the associated start-of-page signals.

10 Claims, 3 Drawing Sheets

METHOD FOR AUTOMATICALLY CORRECTING IMAGE REGISTRATION AND IMAGE TRANSFER SYSTEM EMPLOYING THIS METHOD

BACKGROUND OF THE INVENTION

The present invention relates to a method and system for automatically correcting image registration in an image transfer system comprising a plurality of moving, image-forming media on each of which an image is formed in response to a corresponding start-of-page (SOP) signal. An image carrier is moved past each of the image-forming media and is brought into contact therewith in a respective transfer zone.

The problem of correcting image registration occurs, for example, in a color copier or printer, in which it is essential for obtaining a good image quality that the various color separations are superimposed correctly on the image carrier. For example, a four color reproduction system comprises four image-forming media corresponding to the four basic colors, i.e. yellow, cyan, magenta and black.

The image-forming media may be drums or belts on which a developed toner image in the corresponding color can be formed by any known process, e.g. by a direst induction process or by a xerographic process. In the latter case, the surface of the image-forming medium is formed by a photoconductor on which a charge image is formed by image-wise exposure with light and then the charge image is developed with toner.

The image carrier may be a sheet of copying paper on which the desired image is to be recorded or an intermediate carrier (belt or drum) from which the color image is then transferred to the final recording medium in a second transfer step. In any case, the image carrier is successively moved through the various transfer zones, so that the developed single-color images (color separations) are superposed on the image carrier to form the desired multiple-color or full-color image.

In each transfer zone the image carrier is brought into contact with the corresponding image-forming medium in a nip which may be constituted by the image-forming medium and the image carrier themselves or, in case of a belt, by rollers supporting the belt. In order to obtain a correct registration of the superimposed images, the mechanical components of the transfer system have to be adjusted correctly, and the timings of the SOP signals, which define the positions of the leading edge of the image on the respective image-forming medium, have to be selected properly, such that the leading edges of all images will coincide on the image carrier. In the course of time, however, the mechanical components are subject to wear or aging, thermal expansion and the like, so that the image registration may be altered to an extent which is not acceptable in a high resolution system.

U.S. Pat. No. 4,937,664 discloses a laser printer in which the image registration can be checked and corrected automatically, for example in the warming-up phase each time the printer is switched on. To this end, the image-forming units are arranged to form registration marks on the image carrier. A detector for detecting these registration marks is arranged downstream of the image-forming units and compares the timings at which the registration marks are detected to corresponding target values. In case of a deviation, a mechanical component of the associated image-forming unit, e.g. the optical exposure system is readjusted by means of an actuator in order to compensate for the misregistration. The registration marks formed on the image carrier are then erased again, so that the system will not be confused when new marks are generated in a subsequent correction cycle.

In conventional color copiers or printers, in general, the drive systems for the various image-forming media and the image carrier are mechanically coupled to one another through gears or the like, so that all image-forming media are forcibly driven at the same speed as the image carrier. This facilitates the adjustment of image registration, but has the drawback that a rather complex mechanical system is required. With increasing resolution of the printer and, accordingly, increasing accuracy requirements, it becomes increasingly difficult and expensive to suppress effects resulting from gear play, manufacturing tolerances of the gear teeth and the like to an acceptable limit.

Theoretically, the speeds of all image-forming media should be exactly identical, because they are all held in contact with the same image carrier. However, it is found that in practice the natural speeds of the image-forming media, i.e. the speeds the image-forming media would acquire if they were allowed to idle, are slightly different from one another. These speed differences may for example result from variations in the thickness of the image carrier belt, variations in the thickness of the toner layer, and from slight elastic deformation of the image-forming medium or the image carrier due to forces acting in the nip in the transfer zone. When the image-forming media are forcibly driven at the same speed, these differences in the natural speeds may result in undesirably high tangential forces or torques which act upon the image carrier in the transfer zone and may impair the image quality or the lifetime of the image carrier and other mechanical components.

U.S. Pat. No. 4,705,385 discloses a color printer in which the image carrier and the image-forming medium are driven independently from one another with controllable speeds. There is only provided a single image-forming medium in the form of a photoconductive belt,the length of which is an integer multiple of the circumferential length of the image carrier. The various color separations are formed one after the other on the same photoconductive belt and are transferred to the image carrier after each complete revolution of the latter. The drive system for the photoconductor serves as a master to which the drive system of the image carrier is slaved. More specifically, servo control devices keep track of the displacements of the photoconductor and the image carrier, and when the image carrier has fallen behind or gotten ahead of the photoconductor belt, the displacement of the image carrier is corrected within a short time interval in which image free seam areas of the belts are in contact with each other. Thus, all color separations will be superimposed on the image carrier with correct image registration. Since this system employs only a single image-forming medium, there is no need to cope with registration errors resulting from speed differences between image-forming media. However, the use of only a single image-forming medium leads to losses in productivity.

SUMMARY OF THE INVENTION

It is an object of the present invention to provide a method and system for automatically correcting image registration, which requires little mechanical complexity and nevertheless corrects image registration errors accurately while maintaining tangential forces in the image transfer zones within acceptable limits.

According to the present invention, this object is achieved by the method and system as specified herein.

The method is characterized in that the image-forming media are driven independently from one another and the timing of the SOP signals and/or the speeds of the image-forming media are controlled to maintain a fixed relationship between the longitudinal image distortions occurring in each transfer zone and the timings of the associated SOP signals.

Any slip or differential speed between the image carrier and the individual image-forming media leads to a longitudinal image distortion in the transfer process, that is, the length of the developed image in the image-forming medium, as measured in the direction of movement of this medium, will be different from the length of the image after it has been transferred onto the image carrier. The longitudinal image distortion is defined as the ratio between these lengths. Since the image-forming media are driven independently, the image distortions may be different from one another, and these differences would generally give rise to image registration errors. Even if the leading edges of the images are exactly in registry, the different image distortions would lead to a mismatch gradually increasing towards the trailing edges of the images. As is generally known in the art, this kind of registration errors can be avoided by synchronizing the line pulses of the image-forming units with the displacement of the image carrier. Then, the distance between the image lines formed on the image-forming medium varies in accordance with the speed difference between the image-forming medium and the image carrier, so that a first image distortion already occurs when the image is formed. When the image is then transferred onto the image carrier, the same speed difference gives rise to an image distortion in the opposite sense, so that the two distortions cancel each other. However, the speed of the image-forming medium will still have an effect on the exact position at which the leading edge of the image is transferred onto the image carrier. More precisely, when two image-forming units are so arranged that the path of travel of the image-forming medium from the image-forming position to the transfer position has the same length L for both systems, and DS is the difference in the image distortions (longitudinal scaling factors) in the two units, as compared to the situation existing when the system was calibrated, then the resulting registration error will be DR=DS L.

Thus, when the image distortions S of all image-forming media are known, it is possible to calculate the image registration errors resulting therefrom and to compensate these errors by appropriately adjusting the timing of the respective start-of-page signals (SOP) relative to the displacement of the image carrier. Accordingly, a fixed relationship will be established between the image distortions and the timings of the associated SOP signals. When the image distortions tend to change in the course of time, for example as a result of changes in the hardness of the nip-forming rollers or changes of the nip pressure due to mechanical stains in the machine frame, then the SOP timings and/or the speeds of the image-forming media are controlled in order to maintain this fixed relationship.

This concept permits the use of a system with idling image-forming media, i.e. a system in which the image-forming media are not actively driven but are driven solely by the frictional contact with the image carrier in the transfer zone. This greatly reduces the mechanical complexity and also eliminates the undesirable tangential forces in the transfer zones.

On the other hand, if the image-forming media are actively driven, then it is possible to control the speeds or displacements of the image-forming media and hence the associated image distortions instead of or in addition to controlling the SOP timing. In this case, it is, for example, possible to control all image-forming media to a target speed derived from the movement of the image carrier, so that all DS are reduced to zero. The effect would be comparable to a mechanical coupling by gears, but this effect would now be achieved with less mechanical complexity and also by avoiding errors resulting from gear play, irregularities of the gear teeth and the like.

A particular advantage of this system is that the target speed of the image-forming media can easily be varied. If, for example, the surfaces of the image-forming media have become harder due to material aging, and accordingly the natural speeds of the image-forming media have become higher, it is possible to increase the target speed for all image-forming media in the same proportion to the speed of the image carrier, so that the tangential forces in the image-forming zones will not become unduly high. This will change all image distortions by the same amount, so that the various DS remain zero. If desired, it is also possible to change the target speeds independently from one another (DS 0) and to correct the registration errors by adjusting the SOP timing, accordingly.

It is also possible to modify the natural speed of the image-forming media by changing the nip pressures in the transfer zones.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
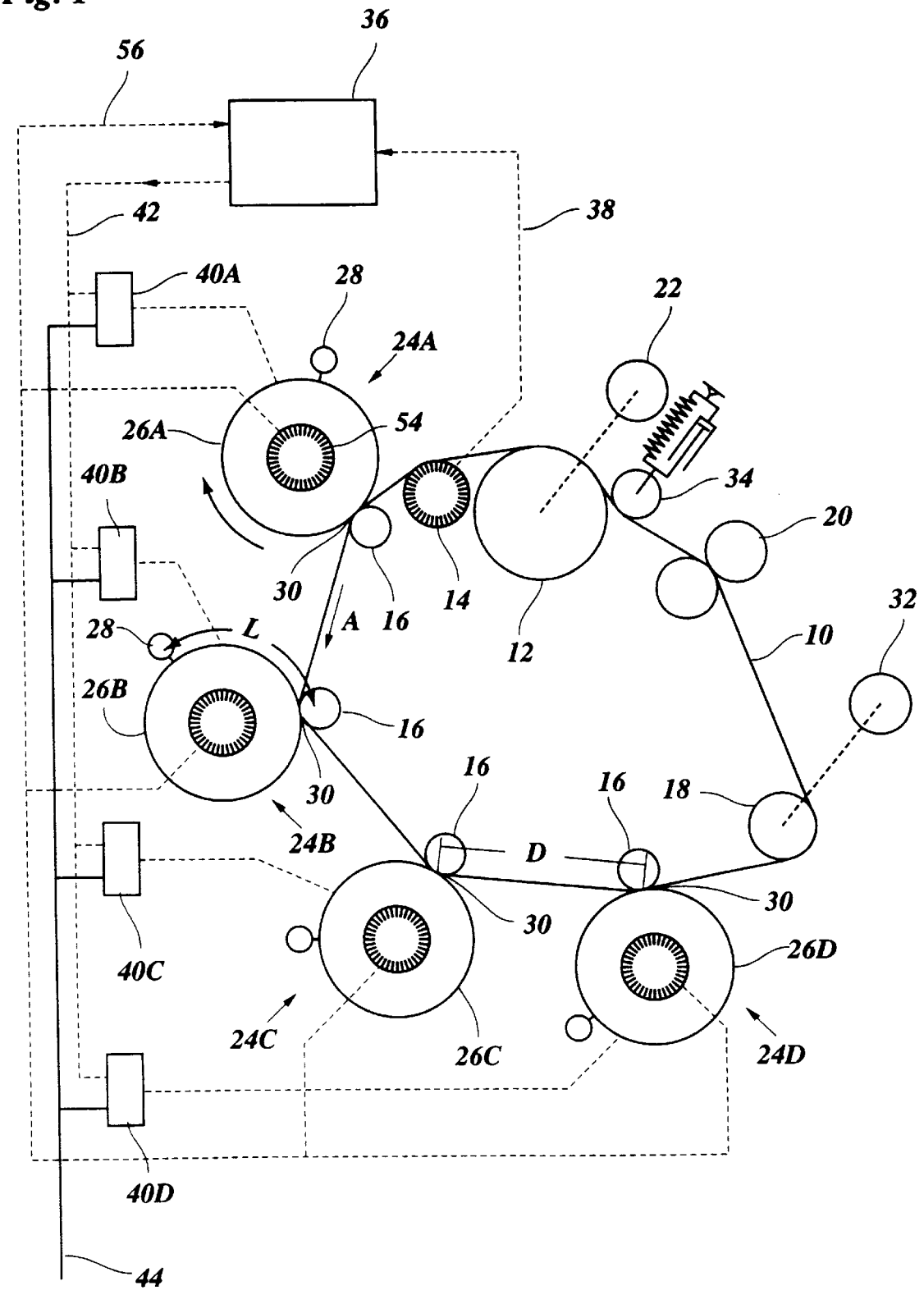
FIG. 1 is a diagram of an image transfer system according to one embodiment of the present invention.

As is illustrated in FIG. 1, an image carrier is formed by an endless belt 10 which is passed over a drive roller 12, a measuring roller 14, support rollers 16, a deflection roller 18 and through a transfuse station 20. The drive roller 12 is driven by a motor 22, so that the belt 10 is moved in the direction of arrow A. The motor 22 drives the drive roller 12 with a constant speed and may optionally be feedback-controlled by a signal from the measuring roller 14 which detects the displacement of the belt 10.

Four image-forming units 24A, 24B, 24C and 24D are equidistantly disposed along the path of the belt 10 and are each adapted to form a toner image in one of the four colors yellow, cyan, magenta and black. The image-forming units have essentially the same construction and each comprises a drum 26A, 26B, 26C and 26C (commonly designated by 26) serving as the image-forming medium, and an image-forming system 28. In the shown example, it is assumed that the image-forming units employ a so-called direct induction printing (DIP) process. Thus, as is generally known in the art, the drum 26 comprises a large number of parallel, circumferentially extending electrodes which can individually be energized in accordance with an image signal, and the image-forming system 28 is formed by a magnetic knife by which the toner image is developed line-by-line in accordance with the energizing pattern of the electrodes. Such direct induction printing process is described more in detail e.g. in European Patent No. 0 191 521. Each of the drums 26A, 26B, 26C and 26D is arranged opposite to one of the support rollers 16 and forms a nip 30 through which the belt 10 is passed so that it is brought into contact with the surface of the drum. The nip 30 thus defines a transfer zone in which the image formed on the surface of the drum 26 is transferred onto the belt 10.

The drive roller 12, the measuring roller 14, the deflection roller 18, the rollers of the transfuse station 20 and the drums 26 of the four image-forming units are mounted in a common rigid frame (not shown), so that a fixed positional relationship is established. The support rollers 16 are elastically biased against the corresponding drum so as to generate an appropriate nip pressure. In this embodiment, the drums 26 are designed as idling rollers which are driven to rotate in the direction of arrow B solely by frictional engagement with the moving belt 10. The center lines of each pair of adjacent nips 30 are spaced by the same distance D. Preferably, at each of the support rollers 16 the belt 10 is deflected by the same angle, so that the mechanical configurations of the image-forming units are practically identical.

The toner images formed on each of the drums 26A–26D are superimposed on the belt 10 to form a multiple-color or full-color image which is then transferred onto a sheet of paper (not shown) in the transfuse station 20. A belt tensioner 34 arranged between the transfuse station 20 and the drive roller 12 absorbs any changes in belt tension or belt speed which might be induced by the paper sheets brought into contact with the belt 10 in the nip of the transfuse station 20.

In each of the image-forming units the magnetic knife 28 (schematically shown in FIG. 1 and enclosed in detail in European Patent No. 0 191 521, referred to hereinabove), defines an image-forming position at the circumference of the associated drum 26. The circumferential length L between the image-forming position and the transfer position defined by the nip 30 is the same for all image-forming units.

The measuring roller 14 is connected to a controller 36 via a line 38 and transmits a signal representative of the displacement of the belt 10. As is generally known in the art, the measuring roller 14 may include an encoder which generates a high-frequency pulse signal the frequency of which is proportional to the rotation of the roller 14 and hence the displacement of the belt 10. The frequency of the encoder should be relatively high in order to provide a high resolution. This resolution may be enhanced further by electronic interpolation techniques, as is also known in the art.

The control system further includes a timing circuit 40A, 40B, 40C and 40D for each of the image-forming units. The timing circuits may be incorporated in the controller 36 and have been shown separately only for illustration purposes. On a line 42 the controller 36 delivers a clock signal to each of the timing circuits. This clock signal is synchronized with the displacement of the belt 10. When a printing command for printing an image is supplied on a line 44, each timing circuit causes the associated image-forming unit to start printing the first line of the image with a predetermined delay, expressed in pulses derived from roller 14 and thus being related to the displacement of the belt 10.

At first, the first line of an image is formed by the magnetic knife 28 on the drum 26A of the first image-forming unit 24A. When the drum 26A has travelled the distance L, this first image line is transferred onto the belt 10. While the leading edge of the image on the belt 10 moves towards the second image-forming unit 24B, the printing of the first image line in this second image-forming unit 24B is initialized. The delay set in the counting circuit 40B is so adjusted that the leading edge of the image on the drum 26B and the leading edge of the image on the belt 10 reach the nip 30 of the second image-forming unit exactly at the same time, so that the images are superposed without any registration error. The same applies to the image-forming and transfer processes in the units 24C and 24D, so that all four color separations are superposed correctly.

In each of the image-forming units the printing of a new image line is triggered by a line pulse supplied from the associated timing circuit 40A–40D. These line pulses are also derived from the clock signal on line 42 and are accordingly synchronized with the movement of the belt 10.

If the circumferential speeds of each of the drums 26A–26D is identical with the speed of the belt 10, then the image registration can be maintained with high accuracy, once the appropriate delays have been adjusted. In practice, however, the circumferential speeds of the drums 26 may differ from each other and from the speed of the belt 10, as will now be explained in conjunction with FIG. 2.

Figure 2:
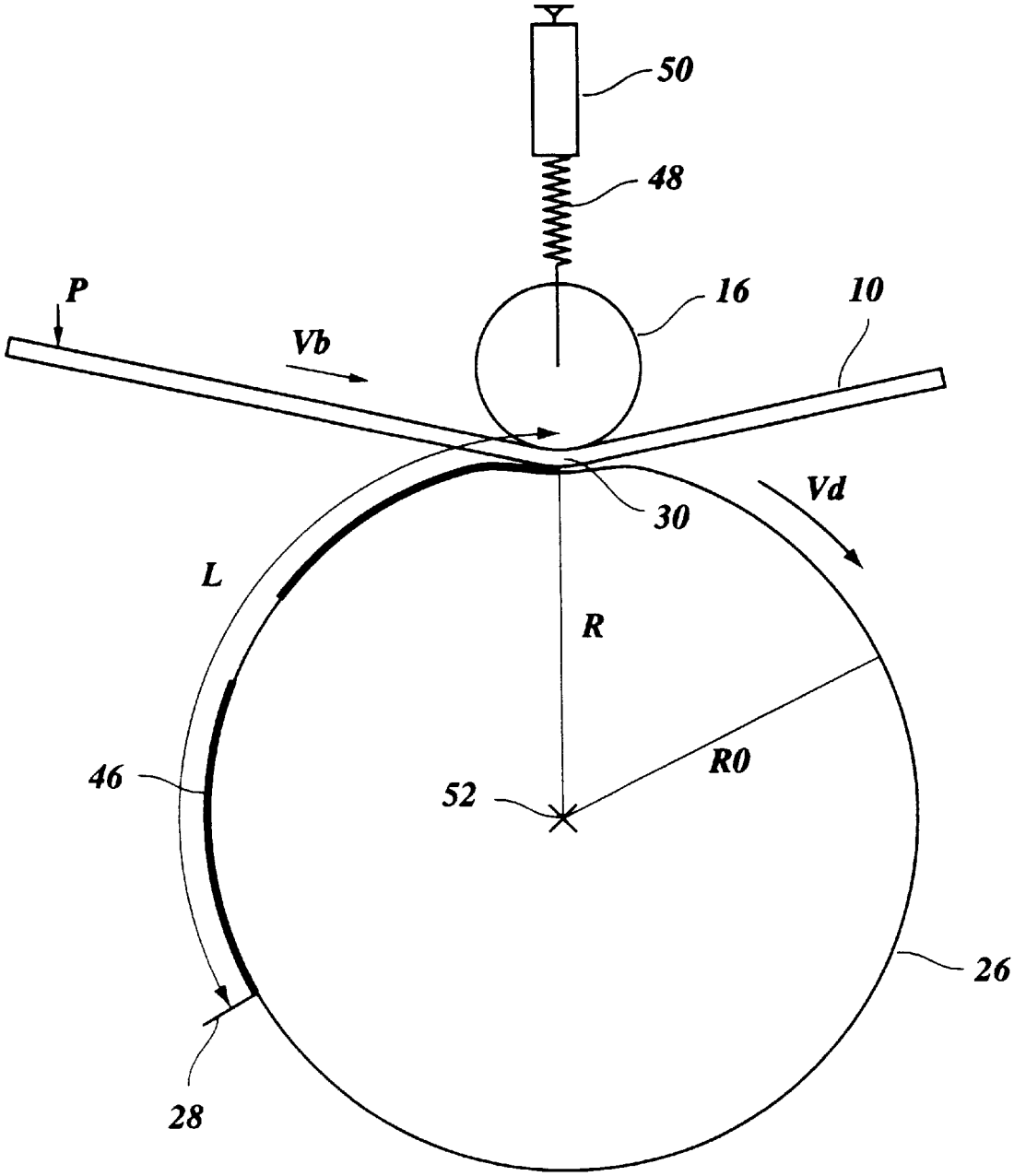
FIG. 2 is an enlarged schematic view of a transfer zone.

In FIG. 2, an image-forming drum 26 and the associated support roller 16 forming a nip 30 with the belt 10 passing therethrough are shown in an enlarged scale. The image-forming position defined by the magnetic knife 28 is disposed at a circumferential distance L from the transfer nip 30. In the shown example, a toner layer 46 corresponding to the dark areas of a developed image has been formed on the surface of the drum 46, and the leading edge of the image has just reached the nip 30.

The support roller 16 is biased against the drum 26 by a spring 48, and, in this case as illustrated, the biasing force, i.e. the nip pressure is adjustable by means of an actuator 50. Since neither the support roller 16 nor the belt 10 nor the drum 16 are absolutely rigid, these members are slightly compressed in the vicinity of the nip 30. This has exaggeratedly been illustrated as a slight depression of the drum 26. As a result, the effective radius of the drum 26, i.e. the distance between the axis of rotation 52 of the drum and the surface of the belt 10 facing the drum may slightly differ from the nominal radius R0 of the drum. The effective radius R, among other factors, is influenced by the thickness of the toner layer (which is generally non-uniform over the area of the image) and by the amount of deformation of the drum 26 which is approximately proportional to the nip pressure.

As was mentioned before, the line pulses which trigger the formation of subsequent image lines at the position of the magnetic knife 28 are derived from the displacement of the belt 10, so that the time interval t between two subsequent line pulses corresponds to d/Vb, wherein d is the desired line pitch of the image on the belt 10. During this time interval t, the surface of the drum 26 travels the distance d'=t Vd=d Vd/Vb. Thus, the image formed on the drum 26 is distorted by a factor S=Vd/Vb in the direction of movement of the drum. When the image is transferred from the drum 26 to the belt 10 at the nip 30, it is again distorted, but this time by a factor 1/S, so that the two distortions cancel each other.

However, the distortion S may nevertheless cause an image registration error for the following reason. Let it be assumed that the leading edge of an image, i.e. the first line of the image is to be transferred to a predetermined position P on the belt 10. Then, when the distortion S is neglected, the start-of-page signal should be applied to the drum 26 at the time when the position P is just the distance L ahead of the nip 30, so that the first line of the image will reach the nip 30 simultaneously with the position P. However, when the distortion factor S is different from 1, the first line of the image will travel the distance L S while the position P travels the distance L. This results in a positioning error of L (S−1).

When the drums 26A, 26B, 26C and 26D in FIG. 1 all have the same distortion S, then all images would be shifted by the same amount, and the images would nevertheless be superposed correctly. But when the distortions of any two drums differ from each other by an amount DS, the result is a registration error D=DS L. Such differences in the distortion may easily occur during long-term operation of the system due to changes in the compressibility of the support rollers 16, the drums 26 or the belt 10, a change of nip pressure, and the like.

A method for correcting the registration error resulting from such effects will now be described in conjunction with FIG. 1.

Each of the drums 26 is provided with an encoder 54 (see unit 24A) which detects the angular displacement and hence the surface displacement of the drum. The corresponding displacement signals are transmitted to the controller 36 via lines 56.

In a correction cycle, which may for example be performed each time the main power has been switched on, while the transfuse station is warming up, the belt 10 is driven with its normal operating speed. The controller 36 receives the displacement signals from the encoders 54 of each image-forming unit and measures the displacement (numbers of encoder pulses) of the individual drums 26A–26D.

Each number of encoder pulses is measured and averaged over a preferably integral number of drum revolutions, so that the result will not be influenced by any possible eccentricities of the drums. The number of revolutions should be as large as practical, in order to improve the accuracy.

The measurements for the individual drums are conducted with a delay which corresponds to the time it takes the belt 10 to move from one nip 30 to the other. Thus, the measurements are carried out while the drums roll over the same portion of the belt 10, so that any possible thickness variations of the belt will influence the measurement results for all drums in the same manner. To this end, the belt 10 may be provided with a mark which is detected every time when it enters a nip 30. Alternately, this mark can be formed on the belt 10 by the first drum 24A at the start of the measuring cycle and be detected in the other image-forming units (24B, 24C, 24D) upon entering the nips 30.

The measurement for the individual drums is controlled by the controller 36 on the basis of the belt 10 displacement counts delivered by roller 14, which for achieving an even higher accuracy, preferably has a circumferential length D, corresponding to the distance D between the transfer nips 30 of two successive image-forming units. For each individual drum (26A–26D) the controller 36 counts the number of control signals (pulse) that is generated by roller 14 during the predetermined number of revolutions of each drum (26A–26D). The number of counts for each drum is compared with a reference number stored in a memory. Based on this comparison and the (fixed) distances L and D, the controller calculates the new SOP-signal for each image-forming unit, which is expressed in count numbers of the roller 14 and stored in a control memory. The reference numbers stored in the memory are set when the machine is manufactured and are obtained in a well-known way in a calibration step, in which for instance, color prints of a specifically designed test image are printed and the SOP signals are adjusted, based upon the registration failures in several test prints, until a print with no registration failures is obtained.

Of course, the correction cycle described above may be carried out more frequently, e.g. each time a predetermined number of prints has been made, or at larger intervals, e.g. only upon request of the user, when the image quality has been found to be unsatisfactory. Also, it will be clear that a correction cycle is executed after replacement of a part of the image-forming system, e.g. the belt 10, a drum 26 or a roller 16. The correction cycles might also be performed continuously while the system is operating.

Alternatively, it would of course be possible to calculate the distortion differences DS and the delay timings for the pairs of image-forming units A–B, B–C and C–D.

As will be understood from the above description, the registration errors to be corrected are proportional to the distance L. It will accordingly be preferable to select this distance L as small as possible in order to further enhance the registration accuracy.

As has been described above, the nip pressure is one of the factors which influences the drum speed and the image distortion S. Accordingly, instead of or in addition to adjusting the delay counts, it would also be possible to correct the image distortions by adjusting the nip pressures by means of the actuators 50.

As will be understood from FIG. 2, minor short-term variations of the distortion S may also be caused by thickness variations of the belt 10. However, as the distance L is the same for each of the drums, these variations will not cause a substantial registration error.

Since the line pulses are derived from the signal of the measuring roller 14 in the embodiment shown in FIG. 1, the eccentricity of the measuring roller 14 may cause slight irregularities in the line pitch of the printed image. By making the circumference of the measuring roller 14 equal to the distance D between successive transfer nips, it is assured that these variations will be the same for all image-forming units and will not lead to registration errors.

In a modified embodiment the measuring roller 14 can be replaced by a stationary detector which detects line pulse encodings that are permanently provided on the belt 10.

Figure 3:
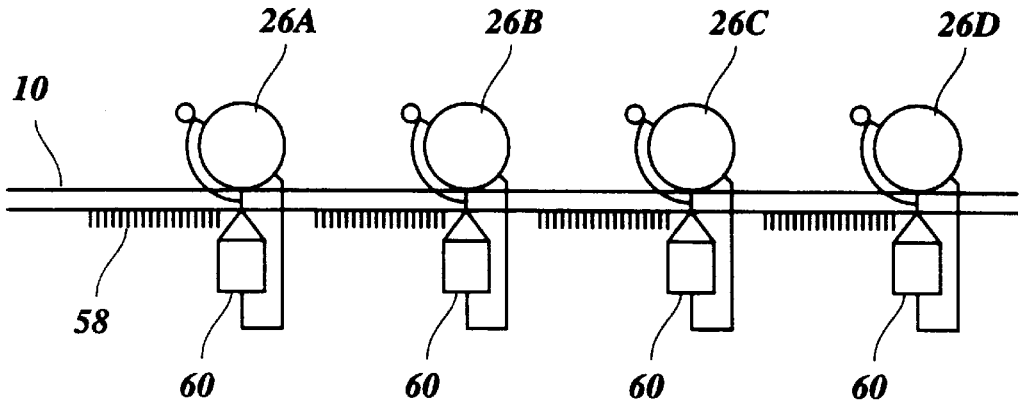
FIGS. 3 and 4 are diagrams illustrating the function principles of modified embodiments of the invention.

FIG. 3 illustrates a further modification, according to which line pulse encodings 58 are provided on the belt 10 and a detector 60 detecting these encodings is provided for each of the drums 26A–26D. In this case, the encodings 58 provide a fixed pattern for the print lines formed in each image-forming unit. The SOP-signal for the image-forming units (26B–26D) is released when a specific line number is counted by the respective detector 60, after release of the SOP-signal for unit 26A. The control and correction of the count numbers is done as described above with reference to FIG. 1.

Figure 4:
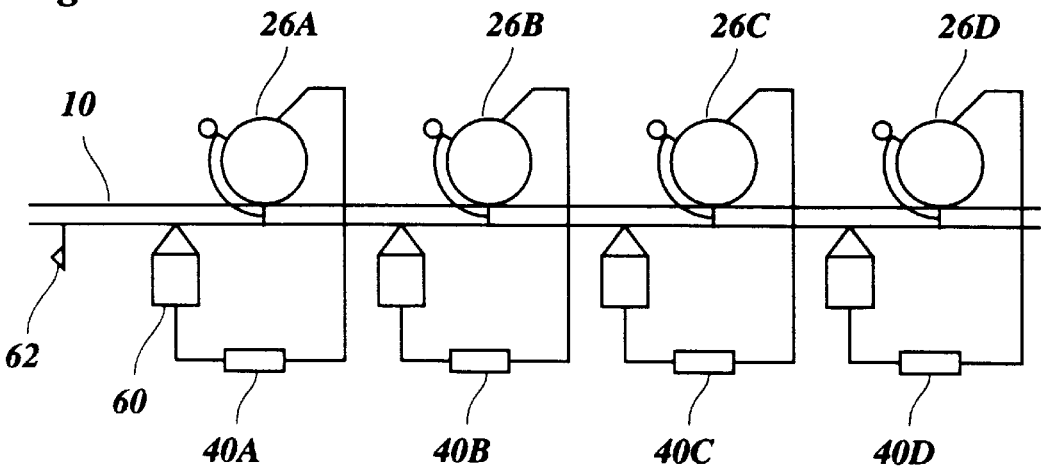

FIG. 4 shows another embodiment, in which a single reference mark 62 is provided on the belt 10. This reference mark 62 is detected by each of the detectors 60 disposed a short distance in front of the transfer nip of each image-forming unit and provides a reference for the start-of-page signal. The timing circuits 40A–40D then have to provide only comparatively short delay times which in the simplest case may consist only of the correction delay times calculated by the controller 36. Optionally, a relatively short fixed standard delay time may be added, which corresponds to the positioning of the detector relative to the transfer position.

In the embodiment according to FIG. 4, the line pulses may be generated in the same manner as in FIG. 1.

According to yet another modification, the first detector 60 associated with the drum 26A in FIG. 4 may be replaced by a writer which writes line pulse encodings derived from a drum encoder on the belt 10. To this end, the belt 10 may, for example, be provided with a magnetic recording strip. These line pulse encodings are then read by the detectors 60 of the other three units. The first encoding written after the receipt of a print command signal serves as a start-of-page signal which is appropriately delayed by the timing circuits 40B–40D. Thus, this embodiment combines the advantages of the embodiments shown in FIGS. 3 and 4. In the embodiments described so far, each of the drums 26A–26D is directly driven by the belt 10 (idling drums). In a full color printer, where several toner layers are superposed in order to obtain mixed colors, the total thickness of the toner layer 46 (FIG. 2) may become so large that its influence on the image distortion S can no longer be neglected. Since the thickness of the toner layer will generally vary over the length of the image, the image distortions and the differences therebetween can no longer be regarded as constant. In order to obtain a proper image registration over the whole length of the image it may then become necessary either to correct the timings of the SOP signals and of the line pulse signals continuously or to control the speeds or displacements of the drums 26 in order to forcibly provide constant image distortion differences DS among the various units. In this respect, FIG. 5 shows an embodiment in which at least the last three image-forming drums 26B, 26C and 26D are driven by respective motors 64.

In the shown embodiment, a writer 66 is associated with the first drum 26A and writes encodings 58 on the belt 10 as has already been described above. The writer 66 is synchronized with the pulse signals obtained from the encoder 54 associated with the drum 26A.

The encodings 58 are read by the detectors 60 each of which delivers a signal indicative of the local displacement of the belt 10 to a respective controller 68. The controller 68 further receives a signal from the encoder of the associated drum 26 and feedback-controls the drive motor 64 for this drum, so that the displacement of the drums 26B–26D is piloted by the encodings 58. An eraser 70 is arranged behind the last image-forming unit 24D to erase the encodings.

Figure 5:
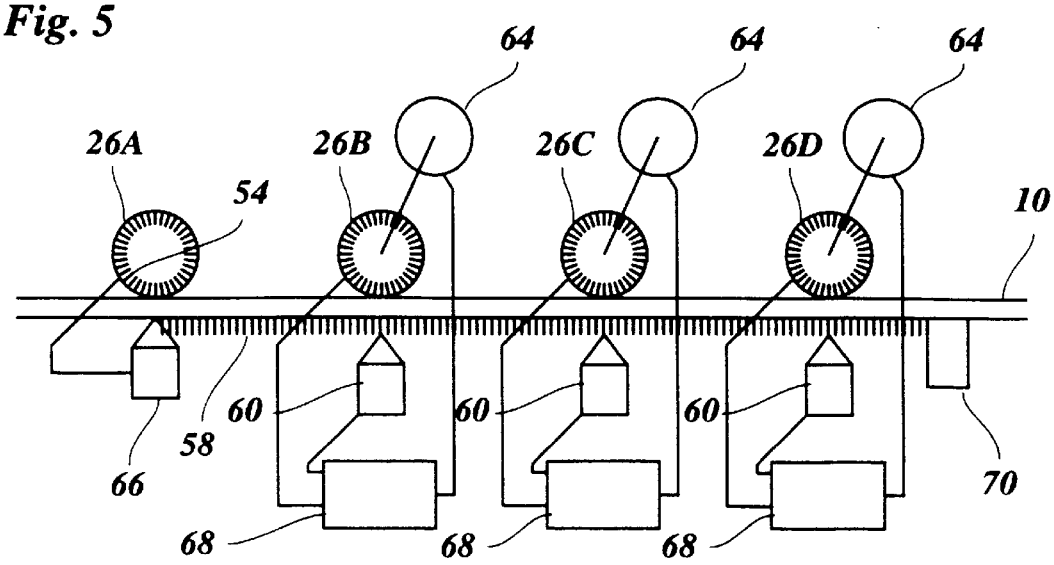
FIG. 5 shows an embodiment wherein the last three image-forming drums are driven by respective motors.

The system shown in FIG. 5 can be operated in various ways.

For example, each controller 68 may be programmed to control the motor 64 such that the pulses obtained from the drum 26 coincide with the pulses obtained from the detector 60. In this case, the distortion S for each of the drums 26B–26D will be locked to that of the drum 26A, and all DS will be equal to zero, so that no correction delay times for the SOP signals are necessary.

The first image-forming drum 26A is an idling drum as in the previous embodiments. This is possible because the toner layer applied to the belt 10 is still relatively thin and will not cause substantial deviations in the image distortion. When the thickness or compressibility of the belt 10 varies over the length of the belt, this may cause changes in the speed and the image distortion of the drum 26A. When the corresponding part of the belt 10 then reaches the subsequent drums, these drums are controlled to forcibly show the same speed changes, so that the variations in the properties of the belt 10 will not give rise to excessive tangential forces or torques in the nips of the units 24B–24D.

If the mechanical properties of the drums 26 (and/or the support rollers 16) are different, this may give rise to different natural speeds of the drums 16. When the speeds of the drums 26B–26D are locked to that of the drum 26A, this may cause tangential forces in the transfer nips. However, the system permits the elimination of these forces by selecting a different target speed for each of the drums 26B–26D. Preferably, these target speeds are still proportional to the speed of the drum 26A but not necessarily identical therewith (i.e. the ratio between the numbers of pulses from the drum 26 and the detector 60 will be different for each image-forming unit). Of course, the different speeds then lead to image distortion differences DS which have to be compensated by appropriately delaying the SOP signal as in the first embodiment.

According to a modification of the system shown in FIG. 5, the writer 66 is replaced by another detector 60, and all detectors detect encodings (e.g. line pulse encodings) that are permanently provided on the belt 10. In the first image-forming unit the number of pulses derived from the drum 26A is compared to the (larger) number of pulses derived from the belt encodings, and the ratio between these pulse counts is stored in a shift register. With a time delay corresponding to the movement of the belt 10 from one nip to the other this ratio is then read by the controllers 68 of the subsequent units and is used to derive the target values for the displacement of the drums 26B–26D on the basis of the signals delivered by the respectively associated detectors 60. Again, the target displacements may either be selected to fulfill the condition DS=0 or may be varied to obtain a DS which is fixed for each image-forming unit and may be compensated for by correction delay times for the SOP signals. In a practical example, the encoders of the drums 26 may deliver a pulse for every surface displacement of the drum by 20 mm. In the case of a 400 dpi. printer this displacement of 20 mm corresponds to 1240 image lines. Thus, 1240 line pulses detected by the detectors 60 will correspond to one pulse of the drum 26, so that the frequency ratio can be varied in steps of approximately one per thousand.

In yet another embodiment, it is possible to define fixed pulse ratios either individually for each image-forming unit or an identical pulse ratio for all units. The first alternative will essentially correspond to the embodiment described in conjunction with FIG. 1 in which each drum 26 has a different image distortion S, with the difference however, that these image distortions are now forcibly held constant and will not be altered by varying thicknesses of the toner layer. The second alternative (all drums controlled in accordance with the same pulse ratio) corresponds to the effect achieved with a conventional mechanical gear coupling. However, the solution according to the present invention has the advantage that the image distortions may now be varied in order to avoid excessive tangential forces in the nips 30.

Instead of using controllers 68 for feedback-controlling the displacements of the drums 26B as in the embodiments described above, it is also possible to use conventional servo control systems which feedback-control the drums 26 to a given target speed. The target speed will then be derived from the speed of the belt 10 and may be modified by an appropriate correction factor in order to take account for the different mechanical properties of the image-forming units and to limit the tangential forces in the transfer nips.

In order to determine the appropriate target speeds or target image distortions S for each image-forming unit, it is desirable to measure the natural speed of each drum 26 in the idling state. On the other hand, in order to provide a stable feedback control system, it is desirable that the drum 26 is rigidly coupled to its drive motor 64, and it would be undesirable to provide a releasable coupling between the motor and the drum. In view of this conflict, the following procedure is proposed for determining the natural speed of the drum.

The transfer nip 30 is opened so that the drum 26 is no longer in contact with the belt 10. Then, the drum is driven by the motor 64 (e.g. a DC motor with PID control) at its normal operating speed. Then the driving torque of the motor 24 is determined under this condition, for example from the I-component of the PID controller or from the controlled input voltage applied to the motor. The torque determined in this way is the offset torque which is necessary for overcoming the frictional resistance in the bearing of the drum 26 and the like. The difference between the driving torque of the motor when the nip 30 is closed and the above offset torque is a measure for the torque transmitted via the nip 30, i.e. the torque which has to be limited by appropriately setting the target speed of the drum. In order to determine the desired target speed, the motor can be driven with the determined offset torque, and the speed can then be measured by the procedure described in conjunction with FIG. 1, i.e. by means of the encoders 54.

In case of a PID-controlled motor, the following procedure is possible: The transfer nip 30 is closed, and the current supply to the motor is limited to the value determined above as a measure for the offset torque. Then, the target speed of the motor is increased to maximum, so that the drum will achieve its natural speed in which the torque of the motor is just sufficient to overcome the frictional resistance. This speed is then measured and is taken as the target speed for the PID controller. After resetting the PID-controller, the limitation of the current supply is removed, so that the controller is fully operative. The drum 26 will then be driven with its natural speed as if it were an idling roller (with no toner layer present in the nip 30). During printing operation the PID controller will constantly drive the drum 26 with this speed, irrespective of whether or not toner is present in the nip 30.

In a similar manner, it is possible to determine the appropriate target speeds for any non-zero torque or tangential force at the nip 30. Once a gauge curve for the relation between the drum speed (image distortion S) and the torque or force transmitted at the nip 30 has been established, any desired torque can be adjusted by appropriately setting the target value for the drum speed.

An alternative possibility to control the speeds of the drums 26 without using drive motors 64 is to vary the nip pressure exerted by the actuator 50 and the spring 48 (FIG. 2). Once the relation between the nip pressure and the image distortion is known, the image distortion can be feedback-controlled by means of the actuator 50.

While only specific embodiments of the invention have been described above, it will occur to a person skilled in the art that various modifications can be made within the scope of the invention which is defined in the appended claims.

What is claimed is:

1. A method for automatically correcting image registration in an image transfer system utilizing a plurality of moving image-forming media on each of which an image is formed in response to a corresponding start-of-page signal and an image carrier moving past each of the image-forming media and brought into pressure contact therewith in a transfer zone, which comprises driving the image-forming media independently from one another and controlling the timing of the start-of-page signals and/or the speed of the image-forming media to maintain a fixed relationship between the timing of a start-of-page signal and the longitudinal image distortion differences DS occurring in the associated transfer zone, and wherein the image distortion differences DS are derived from the ratio of the speed differences of the image-forming media and the image carrier.

2. The method according to claim 1, wherein the image-forming media are drums or endless belts having an identical, circumferential length and the speed differences are measured and averaged over a time interval corresponding to an integer number of revolutions of the image-forming media.

3. The method according to claim 1, wherein the measurements of the speeds of the image-forming media are delayed relative to one another by a time interval corresponding to the time it takes the image carrier to move from one transfer zone to the other.

4. The method according to claim 1, wherein at least one of the image-forming media is actively driven and the speed or displacement thereof is controlled to a target value which is in a fixed relationship to either the speed or displacement of the image carrier or the speed or displacement of one of the other image-forming media.

5. The method according to claim 1, wherein at least one of the image-forming media is driven by a motor, which comprises:

a) driving the image-forming medium at its operating speed, while it is not in contact with the image carrier, and measuring the driving torque of the motor under this condition, b) driving the image-forming medium with a torque having a fixed relationship to the driving torque measured in step (a), while the image-forming medium is in contact with the image carrier, and measuring the speed of the image-forming medium under this condition, and c) controlling the speed of the image-forming medium to a target speed corresponding to the speed measured in step (b).

6. An image transfer system comprising:

a plurality of moving image-forming media, each containing an image formed thereon in response to a corresponding start-of-page signal, an image carrier operatively associated with each of the image-forming media by being brought into contact therewith in a respective transfer zone, separate drive means for each of the image-forming media, and control means for controlling the timing of the start-of-page signals and/or the speed of the image-forming media, thereby maintaining a fixed relationship between the longitudinal image distortions occurring in each transfer zone and the timing of the associated start-of-page signals, wherein the image-forming media are driven only through contact with the moving image carrier, and wherein said control means comprise speed or displacement sensors for each of the image-forming media.

7. The system according to claim 6, comprising a writer associated with a first image-forming medium in the direction of movement of the image carrier and arranged to write encodings on the image carrier in synchronism with the displacement of the first image-forming medium, and wherein said control means comprise detectors operatively associated with each of the other image-forming media and arranged to detect said encodings, and an eraser is provided for erasing the encodings behind a last image-forming medium.

8. The system according to claim 6, wherein at least one of the second to last and the last image-forming media in the direction of movement of the image carrier is driven by a motor and said control means comprises first generating means for generating a first pulse signal indicative of the displacement of a motor-driven image-forming medium, second generating means for generating a second pulse signal indicative of the displacement of the image carrier or a first image-forming medium or the relative displacement of the two, and a controller means for controlling the motor on the basis of the first and second pulse signals so as to maintain a predetermined frequency relationship between these pulse signals.

9. The system according to claim 8, wherein the first image-forming medium is driven only through contact with the moving image carrier.

10. The system according to claim 8, wherein the first image-forming medium is provided with said first generating means for generating a pulse signal indicative of displacement of this image-forming medium, said second pulse signal representing the displacement of the image carrier and said predetermined frequency relationship is derived from the ratio between the pulse signals representative of the displacements of the first image-forming medium and the image carrier (10).

* * * * *